US005692800A

United States Patent [19]

Perin

[11] Patent Number: 5,692,800

[45] Date of Patent: Dec. 2, 1997

[54] ROTATABLE CHAIR WITH MIRROR

[76] Inventor: Nolan A. Perin, 250 Green Meadow La., Pen Argyl, Pa. 18072

[21] Appl. No.: 679,058

[22] Filed: Jul. 12, 1996

Related U.S. Application Data

[60] Provisional application Nos. 60/001,174, Jul. 14, 1995, and 60/001,271, Jul. 20, 1995.

[51] Int. Cl. [6] ..... A47C 7/62

[52] U.S. Cl. ..... 297/185; 297/344.26

[58] Field of Search ..... 297/185, 217.1, 297/344.21, 344.26, 344.22, 423.11, 173

[56] References Cited

U.S. PATENT DOCUMENTS

| | | | |
|---|---|---|---|
| 2,218,302 | 10/1940 | Simjian | 88/74 |
| 2,510,351 | 6/1950 | Simjian | 88/92 |
| 3,131,968 | 5/1964 | Alt | 297/185 |
| 3,806,189 | 4/1974 | Simjian | 297/185 |
| 3,905,642 | 9/1975 | Simjian | 297/185 |
| 4,557,520 | 12/1985 | Simjian | 297/185 |
| 4,767,159 | 8/1988 | Opsvik | 297/423.11 |
| 5,110,181 | 5/1992 | Simjian | 297/185 |

*Primary Examiner*—Milton Nelson, Jr.
*Attorney, Agent, or Firm*—Dechert Price & Rhoads

[57] ABSTRACT

Provided is a chair comprising: a support platform; a central support column attached to the support platform and orthogonal thereto; a reciprocating gear integral to the support column, the gear having coupled thereto a first axle extending upwards and a second axle extending downwards; an arm attached to the second axle; and a seat attached to the first axle, wherein when the first axle is rotated about its central axis in one direction the gear reciprocates that motion so that the second axle rotates about its central axis in the reverse direction. Generally, an appliance such as a mirror will be attached to the arm, thereby providing a chair that allows a user to sit first in the chair with the appliance positioned behind the user and then rotate the seat of the chair while the appliance counter-rotates until it is in a useful position towards the front of the user.

22 Claims, 10 Drawing Sheets

ROTATABLE CHAIR WITH MIRROR

This application claims the priority of provisional application Ser. No. 60/001,174 filed Jul. 14, 1995, and provisional application Ser. No. 60/001,271, filed Jul. 20, 1995.

This application relates to a chair having an integrally attached arm that can be used to rotate a consumer appliance such as a mirror in front of a user or to rotate the appliance behind the chair.

When applying makeup, contact lenses, orthodontic devices and the like, or when shaving or trimming hair, a user generally must stretch over a vanity counter or awkwardly hold a mirror with one hand in order to bring the mirror close enough to facilitate these often delicate manipulations. Thus, there is a need for a device that facilitates bringing a mirror adjacent to a users face while leaving both of the user's hands free.

Simjian has described a chair with a mirror that is rotatably attached via various complex mechanisms in U.S. Pat. Nos. 5,110,181, 4,557,520, 3,905,642, 3,806,189, 2,610,351 and 2,218,302.

The present applicant has devised a much simpler chair with attached appliance that allows a user to sit in the chair with the appliance positioned behind the user and rotate the seat of the chair while the appliance counter-rotates until the appliance is in a useful position.

SUMMARY OF THE INVENTION

In one embodiment, the invention provides a chair having:

a support platform;

a central support attached to the support platform and orthogonal thereto;

a reciprocating gear integral to the central support, the gear having coupled thereto a first axle extending upwards and a second axle extending downwards;

an arm attached to the second axle, and a seat attached to the first axle, wherein the when the first axle is rotated about its central axis in one direction the gear reciprocates that motion so that the second axle rotates about its central axis in the reverse direction. In a preferred embodiment, the arm has an attached mirror. Without limitation, other appliances that can usefully be attached to the arm include platforms for supporting items on which the user is working (which can be a flip-down platform integral to another appliance attached to the arm), tool holders and cases for holding makeup or items used in the care of contact lenses.

DETAILED DESCRIPTION

Figure 1:
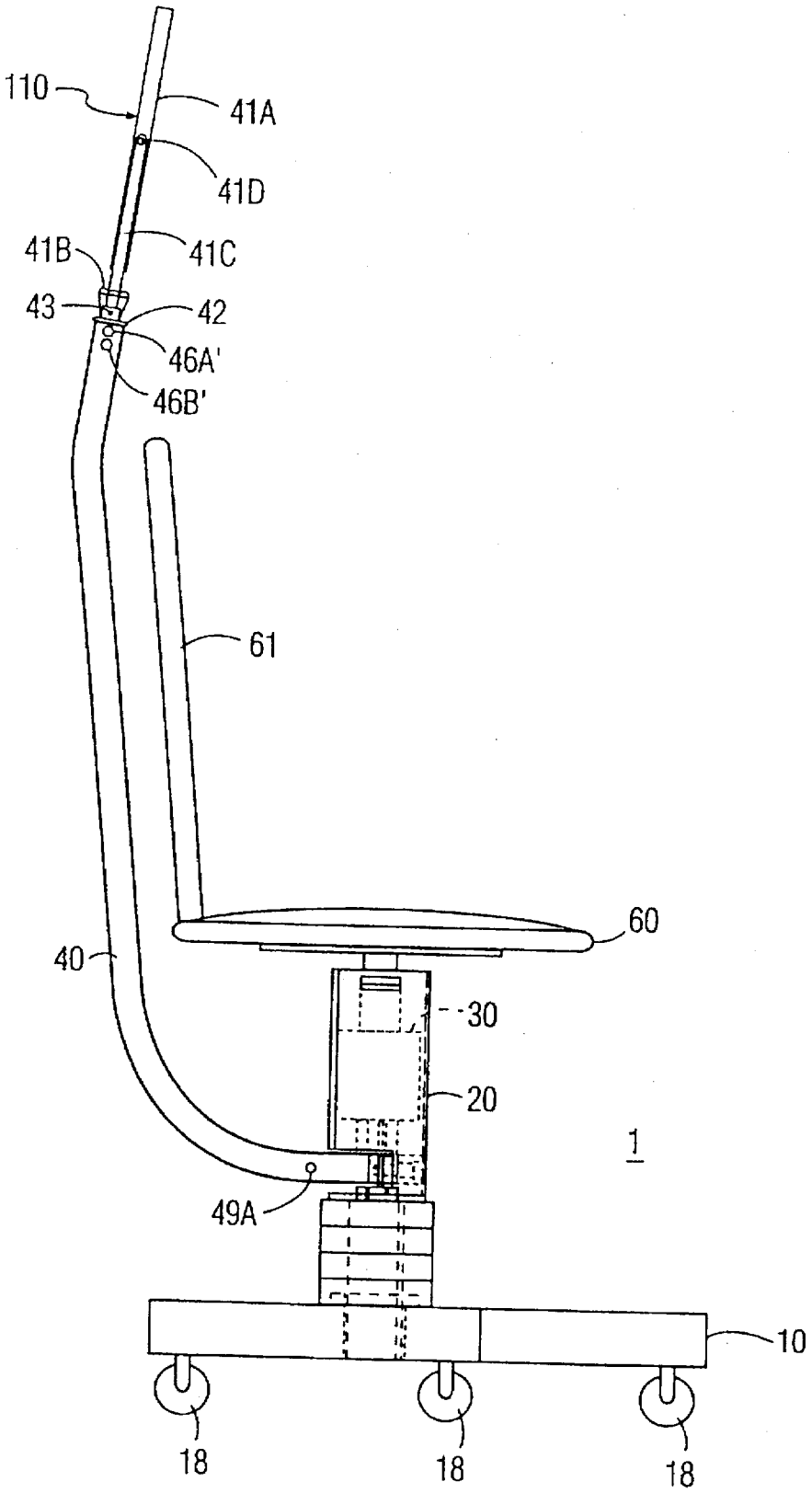
FIG. 1 displays a side view of a chair of the invention with the arm with attached mirror positioned behind the chair.

In FIG. 1, support platform 10 of the chair 1 has five casters 18, three of which are visible in FIG. 1. Support column 20 has a reciprocating gear 30 integral thereto. In the displayed embodiment, the reciprocating gear 30 is in the interior of column 20 and therefore represented by dashed lines. Arm 40 is attached to the column 20 through second axle 32 (seen in FIGS. 3A and 3B).

Figure 2:
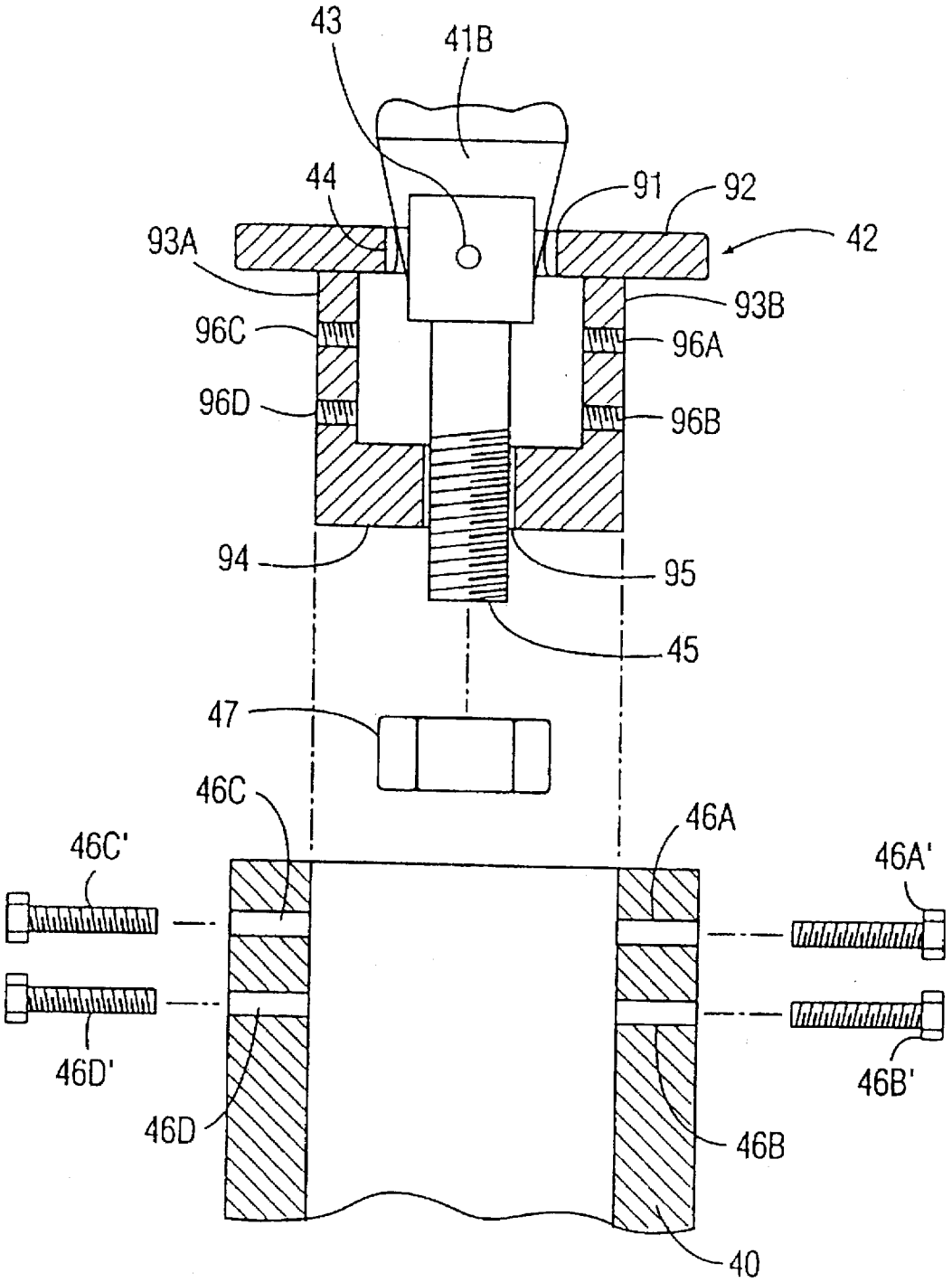
FIG. 2 shows the mirror mount insert with an inserted portion of the mirror assembly, and indicates how it is inserted into the arm of the chair.

Mirror assembly 110 is attached to arm 40 by mount 42, which is shown in expanded view in FIG. 2. The mount 42 slides into arm 40 (which is preferably a hollow box tube) and is secured thereto with bolts 46A'–46D' that are inserted into arm holes 46A–46D (bolts 46A' and 46B' are visible in FIG. 1, while bolts 46C' and 46D' are symmetrically located on the hidden, opposite face of arm 40). The illustrated mount 42 includes a roll pin 43 (available from Bowman Distribution, Cleveland, Ohio) that secures mirror assembly 110 to mirror stud 45. Mirror stud 45 is threaded into the lower panel of mirror mount 42. Mirror stud 45 and mirror assembly 100 are locked into place when nut 47 is tightened. A wedge-shaped lower portion 41B of the mirror assembly 110 is secured within O-ring 44. FIG. 2 shows a cut-away, side view of mirror mount 42. The wedge-shaped mirror portion 41B fits into the first mount hole 91 in panel 92 that is lined with O-ring 44. The bottom panel 94 includes a threaded second mount hole 95 through which mirror stud 45 is threaded. Threaded bolt holes 96A–96D are found on the sides 93A and 93B of mirror mount 42. When mirror mount 42 is slipped into the top of arm 40 bolts 46A'–46D' are inserted through arm holes 46A–46D and into corresponding threaded holes 96A–96D to secure the mirror mount 42 to the arm 40. While numerous other means of attaching the mirror to the arm will be apparent to those of ordinary skill and are within the invention, the illustrated means firmly secures the mirror so that it does not wobble.

Mirror 41A is attached to support bracket 41C by hinge 41D and a second symmetrically-located hinge (not visible in FIG. 1) that allow the mirror to tilt upwards or downwards. Suitable mirror assemblies are available from The French Reflection, Inc., Los Angeles, Calif.

Seat 60 is attached to support column 20 through first axle 31 and gear casing 35 (visible in FIGS. 3A and 3B) and has an attached seat backing 61. Further details on a preferred means of attaching the seat 60 to the support column 20 are discussed below with reference to FIGS. 7A and 7B. Suitable seats include seats with chrome or brass tones available from Classico Seating, Peru, Ind.

Figure 3A:
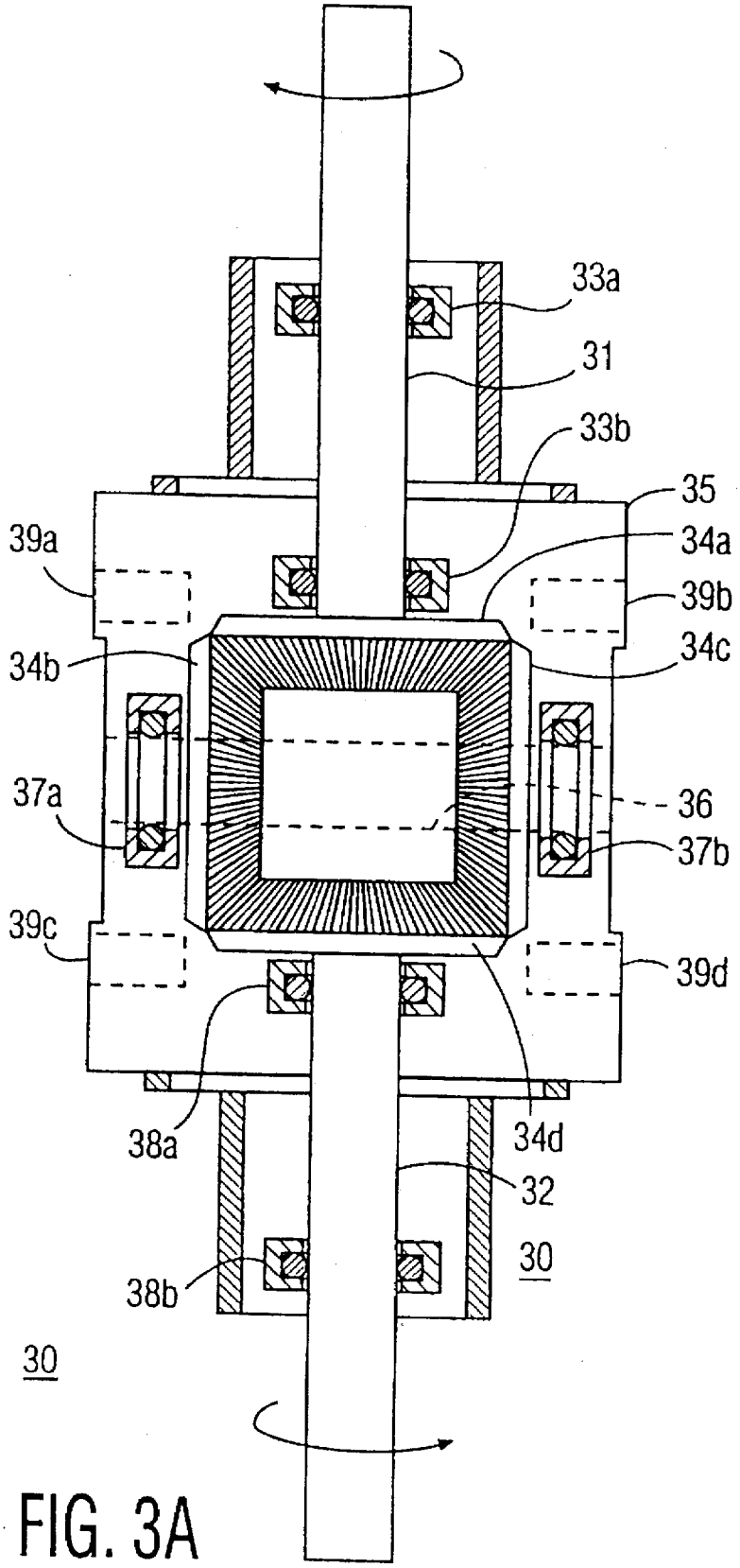
FIGS. 3A and 3B show an examples of reciprocating gears that can be used in the invention.
Figure 3B:
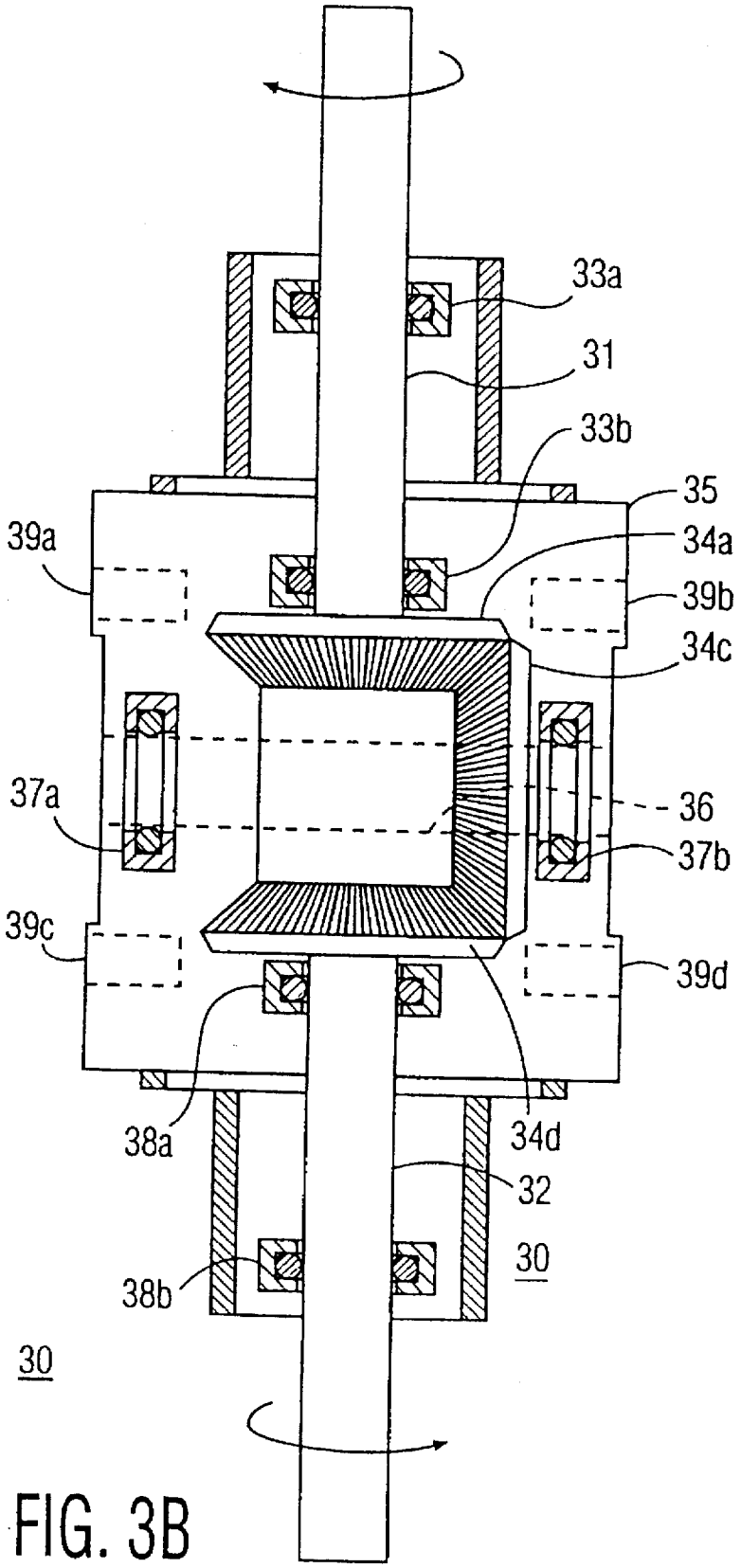

In FIG. 3A, first axle 31, which is seated within first bearing **33*a* and second bearing 33*b*, is attached to a first gear 34*a*. First bearing 33*a* is mounted on an upper extension of gear casing 35, and second bearing 33*b* is mounted on the core portion of gear casing 35. First gear 34*a* is attached to second gear 34*b* and third gear 34*c*, which second and third gears are supported by cross axle 36. Cross axle 36 is seated within third bearing 37*a* and fourth bearing 37*b*, which are mounted on gear casing 35. Second and third gears 34*b* and 34*c*, respectively, are attached to fourth gear 34*d*. Fourth gear 34*d* is attached to second axle 32, which is seated within fifth bearing 38*a* and sixth bearing 38*b*. Fifth bearing 38*a* is mounted on a lower extension of gear casing 35 and sixth bearing 38*b* is mounted to the core portion of gear casing 35. It is apparent that when first axle 31 is rotated in a clockwise direction (clockwise when viewed from above), second and third gears 34***b* and 34*c* will interact with first and fourth gears 34*a* and 34*d* so that second axle 32 will rotate counter-clockwise. Reciprocating gear 30 can be attached to support column 20 by eight bolt holes. Four of these bolt holes, bolt holes 39*a–d* are visible in FIGS. 3A and 3B. Not visible are four bolts holes which are located directly behind corrsponding bolt holes 39*a–d*. For aesthetic reasons, reciprocating gear is preferably mounted only through four bolt holes (either through (a) bolt hole 39*a*, the bolt hole located behind bolt hole 39*a*, bolt hole 39*c* and the bolt hole located behind bolt hole 39*c* or (*b*) through bolt hole 39*b*, the bolt hole located behind bolt hole 39*b*, bolt hole 39*d* or the bolt hole located behind bolt hole 39*d*. FIG. 3B differs from FIG. 3A only in that reciprocating gear 30 lacks second gear 34*b*. The reciprocating gears 30 of FIGS. 3A and 3B provide examples of reciprocating gear means. Reciprocating gears suitable for use in the invention are available from Hub City, Aberdeen, S. Dak. Additional equivalent reciprocating gears will be apparent to those of ordinary skill.

In a preferred embodiment, the gear casing 35 is prepacked with graphite to provide long-term lubrication. In another preferred embodiment, the gears are fabricated of plastic, particularly a high-strength composite plastic. In another preferred embodiment, the bearings of reciprocating gear 30 are self-lubricating bushings.

Figure 4B:
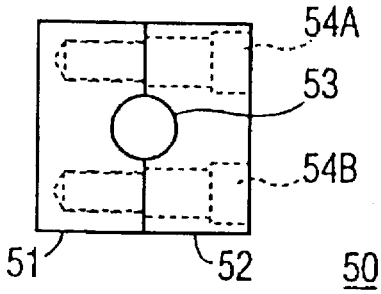
FIGS. 4A and 4B show the arm and the arm mounting blocks.
Figure 4A:
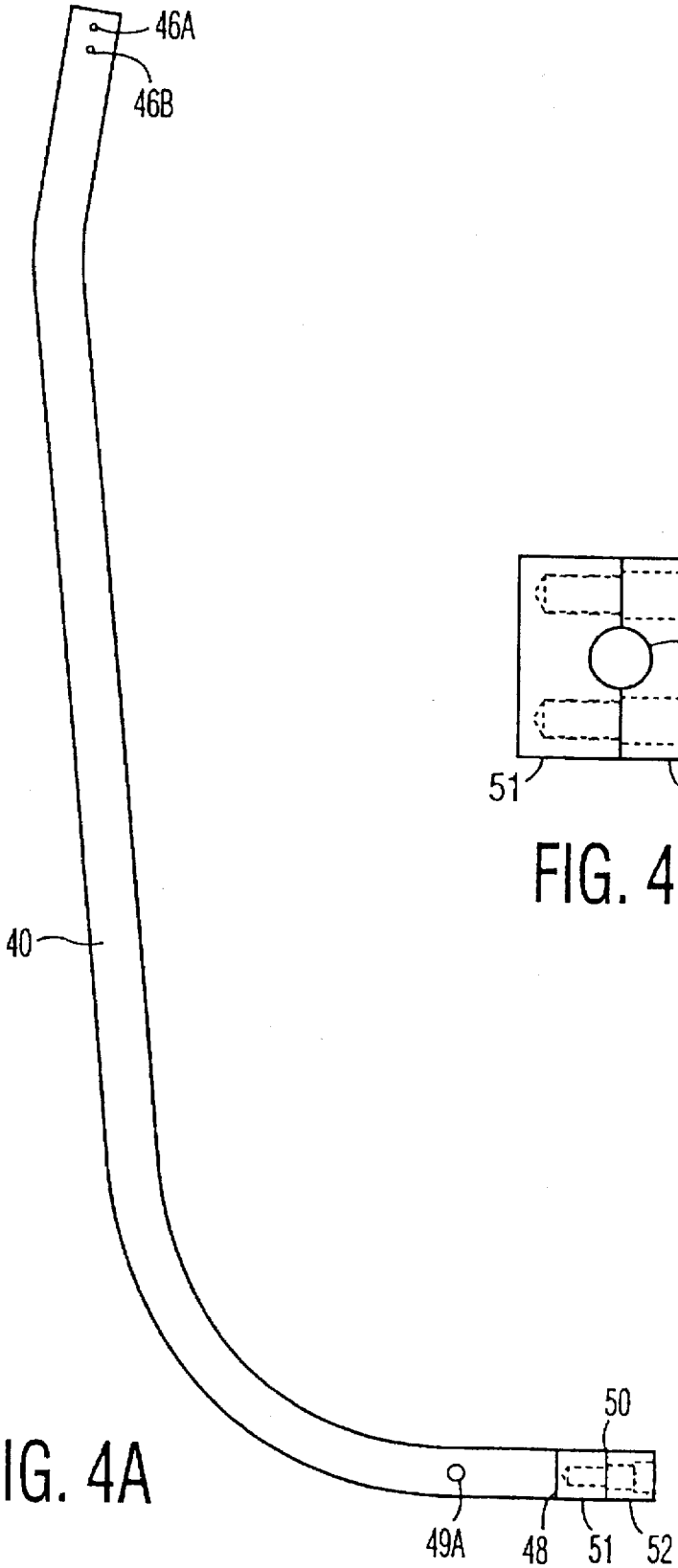

In FIG. 4A, arm 40 is illustrated, including a side view of arm mounting block 50, which is made up of rear mounting block 51 and front mounting block 52. FIG. 4B shows a top view focusing on mounting block 50. Mounting block 50 has a hole 53 (in the illustrated embodiment, having diameter of ⅝ inch) into which second axle 32 fits. Rear and front mounting blocks 51 and 52 are secured together by bolts that fit into bolt holes 54A and 54B. Arm mounting block 50 can be formed from a single piece, preferably of metal (most preferably steel), by first drilling hole 53 through the piece. Bolt holes 54A and 54B are then drilled and tapped. The piece is then cut in two, preferably by sawing it in two. The sawing process removes material from the cut faces of block 50, which provides clearance so that when axle 32 is fitted into hole 53 the bolts fitting into holes 54A and 54B can be tightened so that mounting block 50 securely grasps the axle 32. Rear mounting block 51 is welded to arm 40 at weld-point 48. Arm 40 is preferably constructed of a tube, which can be a box tube, of metal such as aluminum steel, or stainless steel. The arm, including front block 51 of mounting block 50 can be fabricated from separate parts or manufactured as a single piece by a casting process.

Arm 40 preferably has a first bumper 49A (illustrated in FIG. 3A) and a second bumper (which would be on the opposite face of the arm 40 from the first bumper 49A illustrated in FIG. 4A) designed to contact first stop 21 and second stop 22, respectively. second stops 21 and 22, respectively, are located on support column 20, in particular, usually on gear housing 70, discussed below. The first and second bumpers 49A and 49B are preferably constructed of a compressible material suitable for cushioning collisions, such as rubber, neoprene or other plastic. First and second stops 21 and 22, respectively, preferably define a range of arm motion such that the appliance attached to the arm 40 can be rotated in front of chair backing 61 and behind chair backing 61.

Figure 5A:
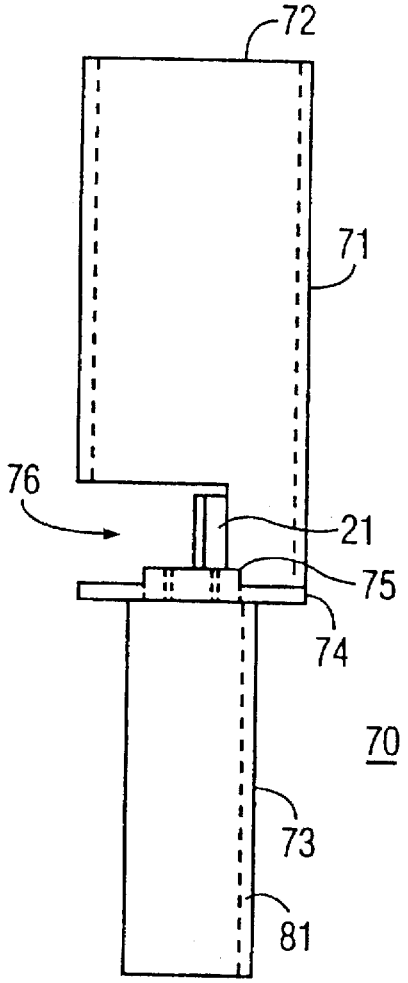
FIGS. 5A to 5D show various aspects of the gear housing, including the part where the arm attaches to an axle extending from the reciprocating gear.
Figure 5B:
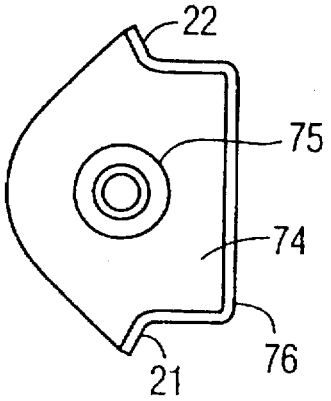

FIG. 5A shows gear housing 70. Gear 30 is secured within upper housing 71. The top 72 of upper housing 71 has a central opening to allow first axle 31 to extend upwards to seat 60. Lower housing 73 is to be secured to support platform 10. On plate 74 is bushing mount 75. Bushing 78 mounts within bushing mount 75. A suitable bushing 78 is a self-lubricating OLITE bronze bushing available from McMaster-Carr, New Brunswick, N.J. In the preferred embodiment illustrated, the lower portion of axle 32 will seat in bushing 78 to stabilize axle 32 against the stress applied by the weight of arm 40. Plate 74 is generally bonded (e.g., by welding) to the walls 76 of upper housing 71 (see FIG. 5B, which shows a top view of the parts affiliated with plate 74). At the part of upper housing 71 adjacent to the mounting position of arm 40, the walls 76 of the upper housing 71 can be shaped to function as first and second stops 21 and 22, respectively, (as illustrated in FIG. 5B). In the illustrated embodiment, first and second stops 21 and 22, respectively, are situated so that arm 40 has a range of motion of about 140°, meaning that the arm 40 and seat 60 can rotate about 2°×140°=280° relative to one another. This range of motion can be adjusted by reconfiguring first and second stops 21 and 22 or changing the thickness of bumpers 49A and 49B.

Figure 5C:
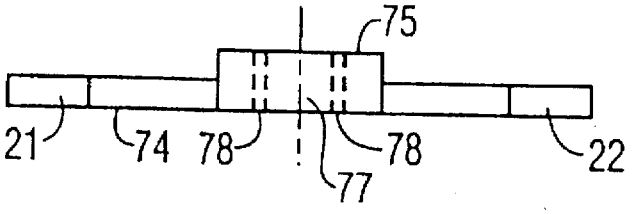

FIG. 5C shows a front view of plate 74, bushing mount 75 and bushing 78. Bushing mount 75 and plate 74 have a contiguous hole 77 extending therethrough in which bushing 78 and second axle 32 seat. Gear housing 70 is preferably constructed of a metal such as steel, stainless steel or aluminum.

Upper housing 71 preferably has rectangular side walls 76. The rear wall of upper housing 71, which is on the same face as opening 79, preferably is constructed of a thicker metal than the other 3 walls, or has an additional supporting piece of metal welded to it.

In FIG. 5A, open area 79 allows the arm 40 to rotate. For some uses the 140° range of motion of the embodiment illustrated in FIG. 5A may be more range than serves a useful purpose. In such a case, the size of open area 79 can be reduced, reducing the range of motion of arm 40. Alternatively, the range of motion can be reduced by reconfiguring first and second stops 21 and 22, respectively, or thickening bumpers 49A and 49B.

Figure 5D:
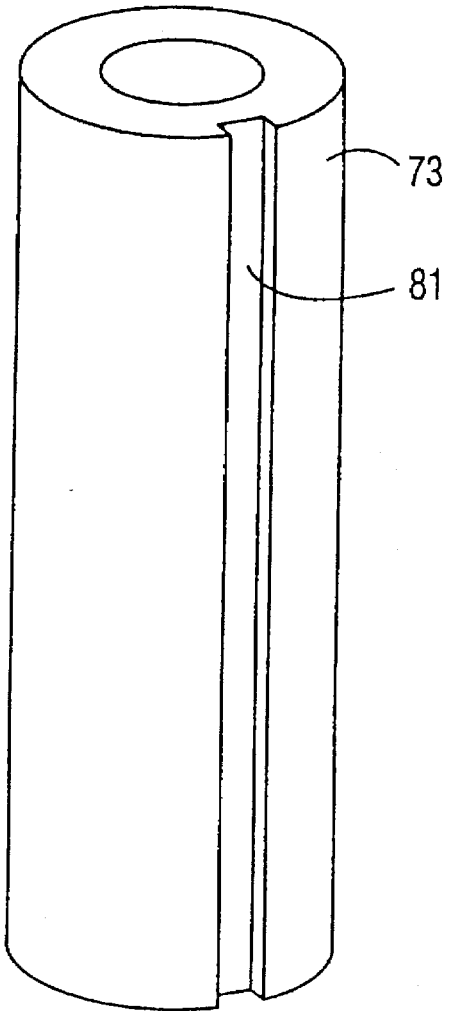

The illustrated lower housing 73 has a slot 81 on the opposite face of the gear housing 70 from open area 79. The slot is indicated in FIG. 5D, which focuses on lower housing 73. This slot interacts with peg 19C in platform 10 (discussed below with reference to FIG. 8) to establish the orientation of the chair and mirror at the various rotated positions of the chair.

Figure 6:
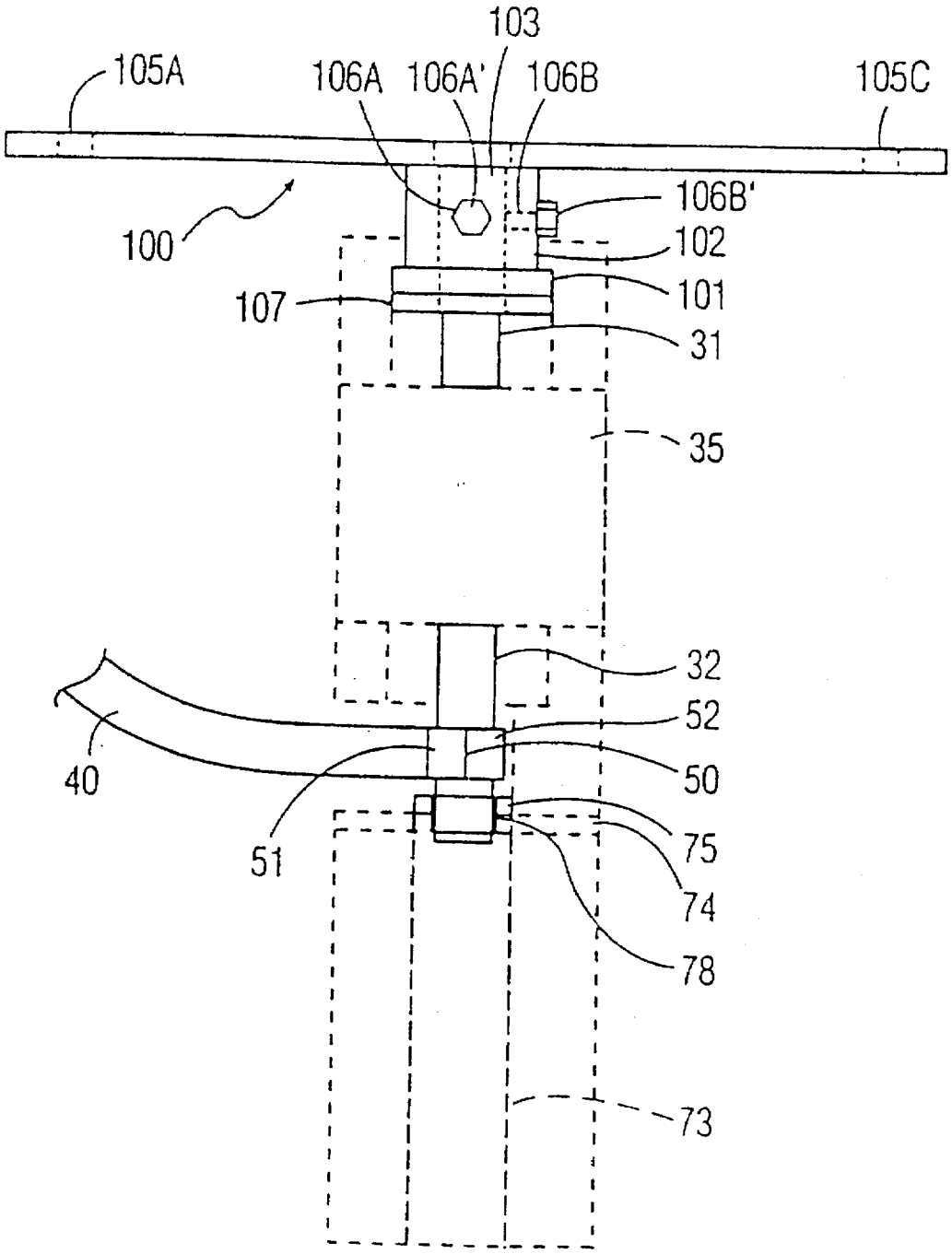
FIG. 6 shows a cutaway section of the central support.

FIG. 6 shows a cut-away for the support column 20 designed to highlight the relationship of second axle 32, arm 40 and bushing 78. Recall that second axle 32 is supported from above by being seated within bearings 38*a* and 38*b* (see FIGS. 3A and 3B). The second axle 32 then extends downwards and is linked to arm 40 by means of, in the illustrated embodiment, arm mounting block 50. The second axle 32 extends below the linkage with arm 40 to a point that is seated in bushing 78. The illustrated second axle 32 thereby has support from above (by bearings 38*a* and 38*b*) and below (by bushing 78).

Figure 7:
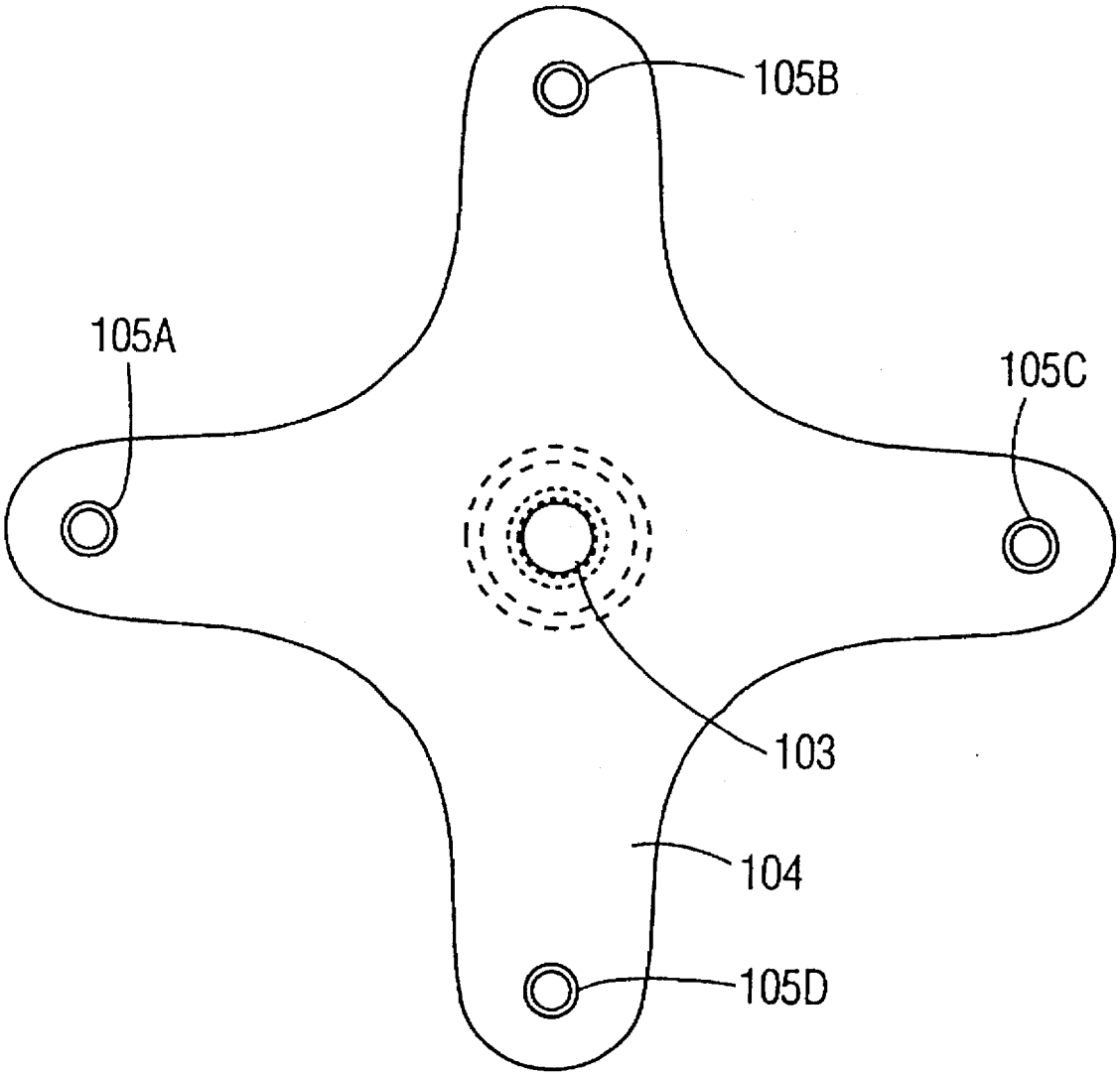
FIG. 7 shows the top of the end cap for the axle extending upwards from the reciprocating gear, which end cap is used to mount the chair seat.

FIG. 6 also highlights a side view of an end cap 100 that seats at the top of first axle 31 and is used to attach the seat 60. A top view of end cap 100 is shown in FIG. 7. Washer 101, which is preferably a steel washer, is bonded to tubular piece 102, which is bonded to seat mounting plate 104. These pieces can be bonded together by welding or can be formed as a single piece using a casting process. Washer 107 rests against the upper extension of casing 35 of reciprocating gear 30 and provides substantial support and lubrication for end cap 100. Washer 107 is preferably a bronze washer.

In another preferred embodiment, a self-lubricating OLITE bronze bushing available from McMaster-Carr, New Brunswick, N.J. is used to serve the function of washer 107. Tubular piece 102 generally has two threaded screw holes 106A and 106B, preferably offset by 90°, through which bolts 106A' and 106B' are tightened against axle 31 (which seats within hole 103). Seat mounting plate 104 has seat mounting holes 105A–105D through which bolts are inserted to affix seat 60 to the end cap 100. Numerous other means of attaching the seat will be apparent to those of ordinary skill in the art.

Figure 8:
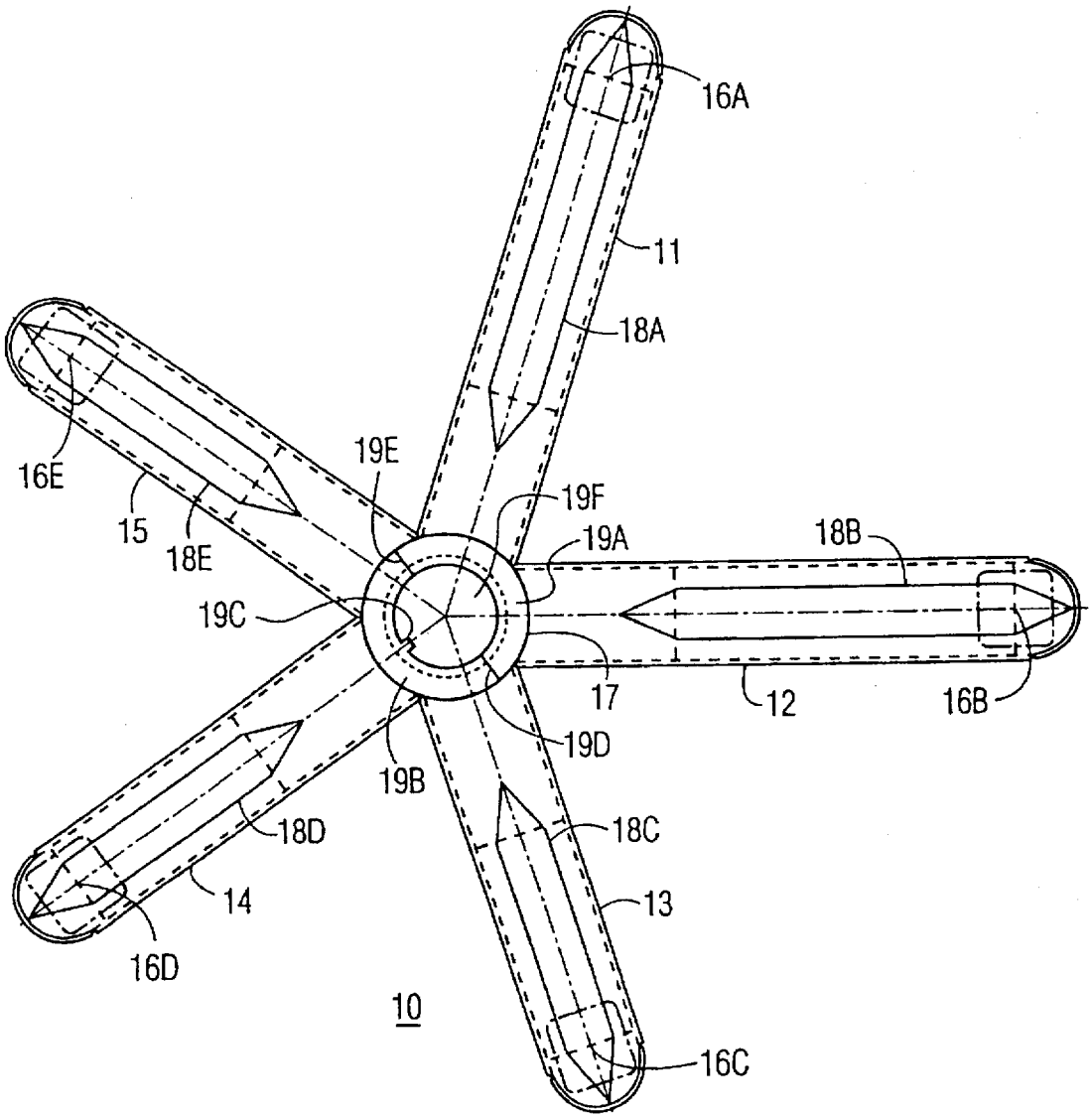
FIG. 8 displays top view of the platform of a chair of the invention.

In FIG. 8, support platform 10 has five members, a first member 11, a second member 12, a third member 13, a fourth member 14, and a fifth member 15, extending from the hub of the platform, above which is seated collar 17. Each member 11–15 is offset from both adjacent members by 72°. Cross-hairs 16*a*–16*e* indicate the pivot axis of casters 18. Casters 11 optionally have a locking mechanism that can be engaged to prevent the chair 1 from rolling.

Collar 17 has a hole 19F into which lower housing 73 seats. Tab 19C fits into slot 81 of lower housing 73. Collar 17 is made up of two parts 19A and 19B, one of which is affixed (e.g., by welding) to the platform 10. The non-affixed part of collar 17 is adjustably attached to the affixed part by bolt mounts so that hole 19F can be enlarged or constricted by loosening or tightening the collar bolts. By constricting hole 19F, lower housing 73 is locked in place. By loosening the collar bolts, lower housing 73 can be raised or lowered to adjust the height of the chair. A suitable collar 17 is the two-piece CLAMP-TITE collar available from Holo-krome, West Hartford Conn. Other means of adjusting the height of the chair will be apparent to those of ordinary skill in the art. For instance, clamp-type devices can be used to secure together the first and second halves 19A and 19B, respectively, of collar 17.

The hub of platform 10 that underlies collar 17 has a platform hole 19G (not shown) aligned with hole 19F of sufficient diameter to allow lower housing 73 to move up or down within it. Preferably, tab 19C extends from this underlying part of platform 10 rather than from collar 17.

In the illustrated embodiment, bronze decorative pieces 18*a*–18*e* are affixed to members 11–15. Any number of decorative shapes and other decorative surfaces, such as gold, chrome or silver plating, can be used. Such decorative pieces 18*a*–18*e* can be affixed by welding screw mounts to the undersides and using bolts mounted through holes in members 11–15.

Those of ordinary skill will recognize that a number of different arrangements of support devices can serve as the support platform. For instance, the support platform could be a base, such as a round or square base. If the platform has members analogous to members 11–15 of FIG. 6, the number of members and the length of the individual members can be varied so long as the chair is supported. Generally, for manufacturing ease and aesthetic value, the members symmetrically extend from the hub so that the angular offset of each pair of adjacent members is the same. However, as those of ordinary skill will recognize, this feature is not essential to supporting the chair.

The support platform can be a stand that is bolted to the floor. Alternatively, the support platform can be an arm that secures the chair to a wall or an associated piece of furniture. For instance, the chair can be affixed by an support arm to a vanity.

In a preferred embodiment of the invention, the shape and dimensions of arm 40 are selected so that a user can sit in the seat 60 with the mirror 41 situated behind the user and rotate the chair 1 to cause the mirror 41 to counter-rotate toward the front of the user so that the mirror 41 is situated at an angle appropriate for viewing the user's face or hair. The upwardly extending portion of the arm 40 preferably has an bent shape so that the appliance mounted on the arm 40 can be brought almost directly in front of the user without the lower part of the arm 40 interfering with the user's legs. The chair with mirror of the invention can be used with another mirror to facilitate viewing the rear of a user's head. For instance, the chair can be positioned in front of a mirror with the chair's mirror 41A situated behind the chair backing 61. The user can seat himself or herself and rotate the chair until the mirror is suitably aligned for viewing the rear of the user's head.

In the illustrated platform 10, members 11 and 12 are longer than members 13–15. In one embodiment and arrangement of the chair of the invention, when the chair is not in use the arm 40 is situated behind the seating backing 61, thereby shifting the chair's center of gravity behind the seating backing 61. Chair 1 can be designed so that this offset center of gravity is situated above a point along a line that is midway between member 11 and member 12. The increased length of members 11 and 12 thereby stabilizes the chair from tipping over due to the offset center of gravity. As the chair is rotated, the seat backing rotates in one direction, while the arm rotates in the other direction. Until each has rotated 90°, the offset center of gravity will be approximately over the two extended members (11 and 12). When each has rotated 90° (or 180° relative to each other), the chair backing offsets the center of gravity in one direction, while the arm offsets the center of gravity in the opposite direction. The degree to which these two center of gravity offsets will adequately equalize will depend on the positioning and relative masses of the arm 40 and seating backing 61.

In another preferred embodiment, the arm 40 has an expansion segment with a locking mechanism that allows the arm to be lengthened or shortened.

A particular advantage of an embodiment of the chair of the invention is that angular relationship of the chair and the backing at the various rotated positions can be firmly fixed so that these relationships do not get out of proper alignment. Otherwise, the parts might, for instance, become so mis-aligned that the mirror only rotates through positions that are roughly in front of the prospective user. This advantage is achieved by using a gear mechanism that does not slip, when pressure is applied, to change the general relationship of the arm 40 and seat 60. Instead, the relationship is firmly established by interdigitating gears.

Support column 20 preferably has a width that is substantially less than the narrowest (in the horizontal plane) part of seat 60. "Substantially less" in this context shall mean the width is no more than about 60% of the seat width. Preferably, column 20 has a width that is no more than about 45% of the width of the seat, more preferably the width is no more than about 35% of the width of the seat, yet more preferably the width is no more than about 25% of the width of the seat. Support column 20 generally provides most of the seating height of the chair. Thus, the height of support platform 10 (including casters, if present) preferably comprises no more than about 45% of the combined height of the support platform 10 and column 20, more preferably the height of support platform 10 comprises no more than about 35% of the combined height. Alternatively, the height of the support platform 10 is about 24 cm or less, preferably 18 cm or less.

Each side of mirror 41 preferably has a reflective surface which can have different characteristics. For instance, one surface may give a standard reflection, i.e., a reflection that neither magnifies nor shrinks the apparent size of a reflected object, while the other provides a magnified view, such as a 3-fold magnified view. In a preferred embodiment, the appliance attached to arm 40 is a lighted mirror. To power the lighted mirror a power cord can be threaded through arm 40.

The gear mechanisms of FIGS. 3A and 3B are illustrative only, numerous variations and alternate reciprocating gears will be apparent to those of ordinary skill in the mechanical arts. Similarly, the other mechanical features of the drawings are illustrative only, and numerous variations to the other elements of the invention will be apparent to those of ordinary skill.

I claim:

1. A chair comprising a support platform;

a central support column attached to the support platform and orthogonal thereto;

a seat;

a reciprocating gear mechanism located on the interior of the support column, the gear mechanism having thereto (a) a first axle extending upwards and fixedly attached to the seat so that any rotation of the seat is matched by a corresponding rotation of the first axle and (b) a second axle extending downwards; and an arm fixedly attached to the second axle, wherein when the seat and thereby the first axle are rotated about its central axis in one direction the gear mechanism reciprocates that motion so that the second axle rotates about its central axis in the reverse direction, and thereby the arm is rotated in the reverse direction.

2. The chair of claim 1, wherein the arm comprises an expansion segment with locking mechanism allowing the arm to be lengthened or shortened.

3. The chair of claim 1, wherein the support column has substantially less width than the seat.

4. The chair of claim 1, wherein the support column has two stops wherein each stop contacts the arm when the arm has rotated to a defined position relative to the support column, the two stops thereby defining the range through which the arm can be rotated.

5. The chair of claim 1, wherein the arm has two bumpers on opposing faces, and each bumper contacts one of the stops to cushion the collision between that stop and the arm.

6. The chair of claim 1 comprising a mirror attached at the end of the arm distal from the second axle.

7. The chair of claim 6 wherein the mirror is pivotally attached to the arm with a bracket that allows the mirror to pivot upwards or downwards.

8. The chair of claim 6, wherein the dimensions of the arm are such that a user can (i) sit in the seat with the mirror situated behind the user and (ii) rotate the chair to cause the mirror to counter-rotate towards the front of the user so that the mirror is thereby moved to an angle appropriate for viewing the user's face or hair.

9. The chair of claim 6, wherein the attached mirror has a first mirror face that provides a standard reflective view and a second mirror face that provides a magnified view.

10. The chair of claim 1, wherein the support platform comprises at least three members extending from a central hub to which the support column is attached, wherein each member has a caster pivotally attached to the end of the member distal from the hub the casters providing a flat base for the chair.

11. The chair of claim 4, wherein the support column has an opening through which the arm attaches to the second axle, and which opening defines a range of motion of the arm, further wherein two said members have extended length and define an are about the hub that encompasses the range of motion of the arm.

12. The chair of claim 11, wherein the support platform has five members extending from the central hub.

13. The chair of claim 10, wherein the platform comprises no more than about 45% of the combined height of the platform and support column.

14. The chair of claim 13, wherein the platform comprises no more than about 35% of the combined height platform and support column.

15. The chair of claim 14, wherein the height of the platform is no greater than about 18 cm.

16. The chair of claim 10, wherein the height of the platform is no greater than about 24 cm.

17. A chair comprising a support platform;

a central support column attached to the support platform and orthogonal thereto;

a seat;

a reciprocating gear means located on the interior of the support column, the gear means having coupled thereto (a) a first axle extending upwards and fixedly attached to the seats so that any rotation of the seat is matched by a corresponding rotation of the first axle and (b) a second axle extending downwards, the means being for reciprocating a rotation of the first axle that the second axle rotates in the reverse direction; and an arm fixedly attached to the second axle, wherein when the seat and thereby the first axle are rotated about its central axis in one direction the gear means reciprocates that motion so that the arm connected to the second axle rotates in the reverse direction.

18. The chair of claim 17, wherein the support column has two stops wherein each stop contacts the arm when the arm has rotated to a defined position relative to the support column, the two stops thereby defining a range through which the arm can be rotated.

19. The chair of claim 18, wherein the reciprocating gear means is a non-slipping gear means.

20. The chair of claim 17 comprising a mirror and a makeup kit attached at the end of the arm distal from the second axle.

21. A chair comprising a seat;

a support platform;

a central support column attached to the support platform and orthogonal thereto;

a reciprocating gear located on the interior of the support column, the gear having coupled thereto (a) a first axle extending upwards and fixedly attached to the seat and (b) a second axle extending downwards, and further having (1) a first gear fixedly attached to the first axle and rotating about an axis of rotation shared with the first axle, (2) a second gear fixedly attached to the second axle and rotating about an axis of rotation shared with the second axle, and (3) a reciprocating gear engaging the first gear and the second gear, wherein the rotation of the first gear in a direction is translated by the reciprocating gear to cause the second gear to rotate in the opposite direction; and an arm attached to the second axle, wherein when the seat and thereby the first axle are rotated about its central axis in one direction the gear reciprocates that motion so that the second axle rotates about its central axis in the opposite direction, thereby moving the arm in the opposite direction.

22. The chair of claim 1, wherein the second axle is supported against lateral motion by a bushing mounted in the support column beneath the attachment of the second axle with the arm.

* * * * *

UNITED STATES PATENT AND TRADEMARK OFFICE

CERTIFICATE OF CORRECTION

PATENT NO. : 5,692,800

DATED : December 2, 1997

INVENTOR(S) : Nolan A. Perin

It is certified that error appears in the above-indentified patent and that said Letters Patent is hereby corrected as shown below:

Claim 5, at line 45; that portion of the claim reading "The chair of claim 1" should read -- The chair of claim 4 --.

Claim 11, at line 1; that portion of the claim reading "The chair of claim 4" should read -- The chair of claim 10 --.

Signed and Sealed this

Third Day of March, 1998

Bruce Lehman

*Attest:*

BRUCE LEHMAN

*Attesting Officer*

*Commissioner of Patents and Trademarks*